US009206977B2

(12) United States Patent
Cain

(10) Patent No.: US 9,206,977 B2
(45) Date of Patent: Dec. 8, 2015

(54) ILLUMINATION ASSEMBLY FOR GARMENT

(71) Applicant: Kendel C. Cain, Miami, FL (US)

(72) Inventor: Kendel C. Cain, Miami, FL (US)

( * ) Notice: Subject to any disclaimer, the term of this patent is extended or adjusted under 35 U.S.C. 154(b) by 0 days.

(21) Appl. No.: 13/943,026

(22) Filed: Jul. 16, 2013

(65) Prior Publication Data

US 2015/0023005 A1 Jan. 22, 2015

(51) Int. Cl.

| | |
|---|---|
| ***F21V 21/08*** | (2006.01) |
| ***F21V 33/00*** | (2006.01) |
| ***A41D 27/08*** | (2006.01) |
| ***F21V 21/14*** | (2006.01) |
| *F21L 4/04* | (2006.01) |

(52) U.S. Cl.

CPC ..... *F21V 33/0008* (2013.01); *A41D 27/085* (2013.01); *F21V 21/145* (2013.01); *F21L 4/04* (2013.01)

(58) Field of Classification Search

CPC ..... F21V 21/0816; F21V 7/08; F21V 21/088; F21V 21/145; F21V 33/0008; F21W 2121/06; F21L 4/04; A41D 27/085

USPC ..... 362/103

See application file for complete search history.

(56) References Cited

U.S. PATENT DOCUMENTS

| | | | | | |
|---|---|---|---|---|---|
| 1,777,379 | A | | 10/1930 | Powell et al. | |
| 2,378,075 | A | | 6/1945 | Frecska | |
| 2,555,871 | A | | 6/1951 | Caggiano | |
| 4,794,496 | A | * | 12/1988 | Lanes et al. | 362/105 |
| 4,924,362 | A | * | 5/1990 | Janko et al. | 362/108 |
| 5,070,436 | A | * | 12/1991 | Alexander et al. | 362/108 |
| 5,359,501 | A | * | 10/1994 | Stevens | 362/108 |
| 5,488,361 | A | * | 1/1996 | Perry | 340/984 |
| 5,690,411 | A | * | 11/1997 | Jackman | 362/103 |
| 5,690,413 | A | | 11/1997 | Coughlin | |
| 6,056,412 | A | * | 5/2000 | Atlee et al. | 362/103 |
| 6,086,213 | A | * | 7/2000 | Holce | 362/84 |
| 6,095,657 | A | * | 8/2000 | Kent | 362/108 |
| 6,517,214 | B1 | * | 2/2003 | Mitchell et al. | 362/108 |
| 6,877,875 | B2 | * | 4/2005 | Yu et al. | 362/105 |
| 6,959,998 | B2 | * | 11/2005 | Tsukamoto | 362/191 |
| 7,377,663 | B2 | | 5/2008 | Desjardin | |
| 7,568,813 | B2 | * | 8/2009 | Barker | 362/108 |
| 7,922,349 | B2 | * | 4/2011 | Hunnewell et al. | 362/157 |
| 2003/0021105 | A1 | * | 1/2003 | Cramer et al. | 362/105 |
| 2004/0150987 | A1 | * | 8/2004 | Shaw | 362/108 |
| 2007/0195520 | A1 | * | 8/2007 | O'Brien | 362/191 |
| 2008/0198578 | A1 | | 8/2008 | Finn | |
| 2011/0038142 | A1 | * | 2/2011 | Ritter et al. | 362/108 |
| 2011/0157875 | A1 | * | 6/2011 | Hunnewell et al. | 362/108 |
| 2011/0188236 | A1 | | 8/2011 | Eichelberger et al. | |
| 2012/0307506 | A1 | * | 12/2012 | Gunn | 362/382 |

* cited by examiner

*Primary Examiner* — Anh Mai
*Assistant Examiner* — Matthew J Peerce
(74) *Attorney, Agent, or Firm* — Malloy & Malloy, P.L.

(57) ABSTRACT

An illumination assembly structured to be supported on an individual, including a garment worn by the individual, having a base connectable to the garment and an adjustment assembly connected to the base. An illumination source is connected to the adjustment assembly and moveable therewith relative to the base. The adjustment assembly is disposed in movable interconnecting relation between the illumination source and the base and is cooperatively structured therewith to facilitate adjustable, multi-directional movement and multi-positional placement of the illumination source on the base. The base may be removably connected to a mounting structure connected to the garment, wherein the mounting structure is dimensioned and configured to be unobtrusive when not connected to the base and disposed in underlying relation to an over garment.

24 Claims, 7 Drawing Sheets

FIG. 3
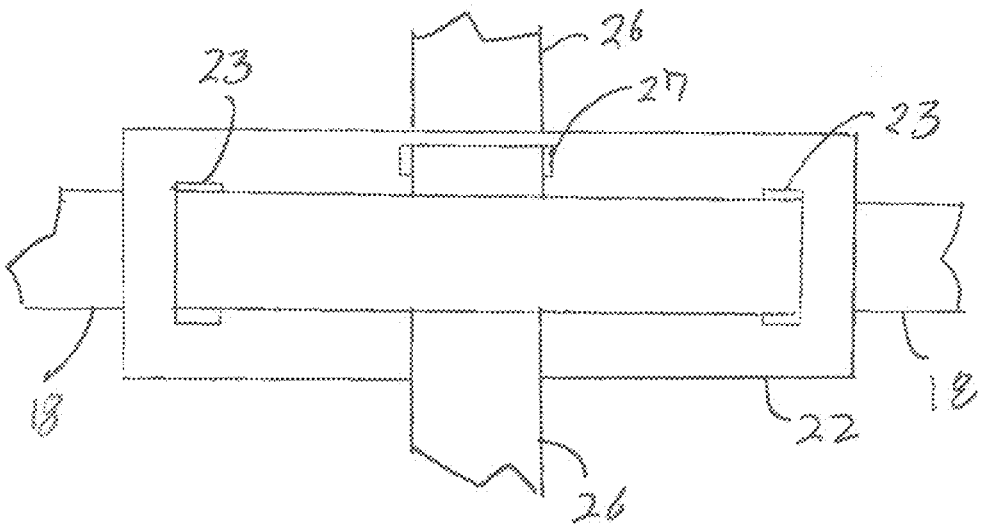
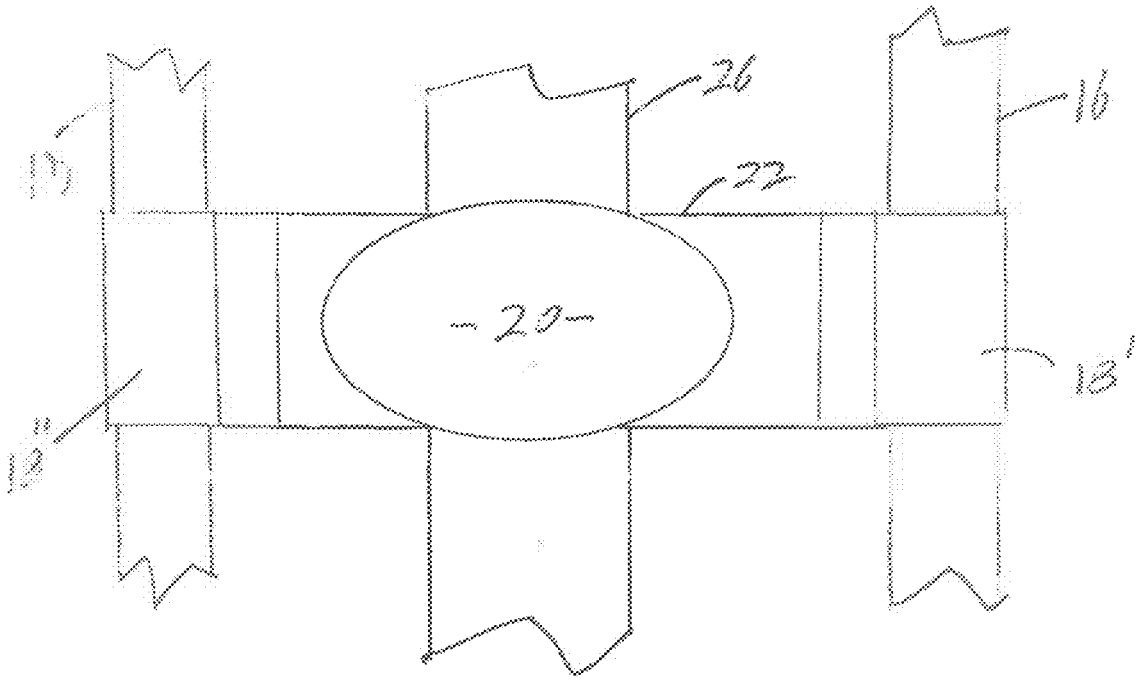
FIG. 4

ILLUMINATION ASSEMBLY FOR GARMENT

BACKGROUND OF THE INVENTION

1. Field of the Invention

This invention is directed to an illumination assembly structured to be supported on an individual, such as by being connected to an individual's garment, with or without the benefit of a mounting structure. At least one adjustment assembly is movably connected to a base of the illumination assembly and an illumination source is structured to be movably connected to the adjustment structure and movable therewith relative to the base. As a result, the adjustment assembly, base and other components of the illumination assembly facilitate the selective, multi-positional, placement and multi-directional movement of an illumination source on the base and the garment to which the base is attached.

2. Description of the Related Art

Illuminated garments and other wearing apparel have been previously made which incorporate some type of illumination and/or reflective surface. Such structuring enables others, not wearing the garment, to more easily recognize the presence and/or location of the individual wearing the garment. In addition, garments of this type are provided with a variety of different illumination devices, which allow the area around the individual to be illuminated and/or highlighted. As a result, the safety of the individual is enhanced, not only in facilitating others to recognize his or her existence, but also by illuminating the surrounding area or environment in which the individual is located during nighttime hours. As a result, the individual may be involved or participate in a variety of different work or recreational activities in locations where and/or when lighting is not at an optimum.

More specifically, sporting activities such as running, walking, bicycling, etc. when performed in the evening or in locations where lighting is poor may be precarious for the participant. This is especially true when such activities take place near relatively busy road ways or other high traffic areas. As is well recognized, there exists an inherent danger to the participant from automobiles whose drivers cannot see them until the headlights of the automobile shine upon the participant. In order to overcome the dangers of such situations, reflective type garments are known and frequently used for both leisure time activities and work environments. However, such garments are not sufficiently adequate because of a limited visual range and a limited ability to illuminate surrounding areas.

Even though high visibility safety vests greatly improve the chance that a wearer will be seen by others certain limitations exist. By way of example, a brightly colored, reflective vest may be adequate for certain applications when used in an environment which is otherwise illuminated. However, numerous other activities as generally set forth above do not lend themselves to the use of this type of safety garment which only include reflective features when illuminated by an external source.

Garments of the type described also include apparel having the aforementioned different types of illumination sources which are operated to generate an illuminated field outwardly from the individual. Such garments include, but are not limited, to an LED and/or incandescent source of illumination. When mounted on a vest or other article of apparel, such illumination sources typically include appropriate electrical circuitry housed within the illumination source itself or otherwise including a separate, attachable and/or portable power source. However, recognized disadvantages associated with structures of this type include an overall bulkiness and/or excessive weight which limits the ability of such illumination sources to be effectively and comfortably mounted on or connected to conventionally styled apparel. Moreover, the larger light generating illumination sources of this type may suffer from a lack versatility by not being able to be adjustably positioned of the garment. In turn, the wearer may not be able to "aim" the generated light field in a preferred direction.

Accordingly, there is a need in this area for an illumination assembly capable of providing a more effective and versatile source of illumination. Such increased versatility would allow the generated illumination field to be directed outwardly in a plurality of directions to illuminate different areas in the vicinity of the wearer. The individual wearing the proposed illumination assembly would thereby have the ability to increase his/her ability to view his surrounding environment, whether in a fixed location or moving. Moreover, such a preferred and proposed illumination assembly may be structured to be used with or without a mounting structure, wherein the mounting structure is connected directly to the garment and the remainder of the illumination assembly is removably connected thereto and the corresponding garment. As such, a proposed mounting structure should be dimensioned and configured to render it substantially unobservable or unobtrusive, when the garment is used without the remainder of the illumination assembly.

In addition versatility of an improved and proposed illumination assembly should be such as to facilitate a multi-positional placement and/or multi-directional movement of the illumination source relative to the mounting structure and/or base on which the illumination source is adjustably and movably disposed.

SUMMARY OF THE INVENTION

The present invention is directed to an illumination assembly which is structured to be supported on an individual, such as by being fixedly or removably connected to a garment worn by the individual. In more specific terms, the illumination assembly comprises a base having an illumination source adjustably connected thereto. The base and illumination source are structured to be interconnected, preferably removably, to the garment by virtue of a mounting structure, itself being connected directly to the garment.

In at least one preferred embodiment, the thickness and/or other dimensions and configurations of the mounting structure are such as to be virtually un-noticeable and/or unobtrusive when secured to the garment. Moreover, in situations when the base, illumination source and cooperative components of the illumination assembly are removed from the mounting structure, a jacket or other over garment may be worn in overlying and/or covering relation to the mounting structure. The illumination assembly thereby allows the corresponding garment to be used in a number of different situations where the illumination source may or may not be needed. In addition, the versatility of the illumination assembly of the present invention is further demonstrated by the aforementioned mounting structure and base being connected to and/or supported by any of a plurality of different types of garments. Such garments specifically include, but are not limited to, an article of apparel intended to be worn on the upper torso portion of the wearer. Such type of garment may include a vest, shirt, blouse, jacket, coat etc.

In addition, the flexibility of both the mounting structure and the base is such as to facilitate the conformance thereof to a shoulder portion of the wearer. Accordingly, at least one preferred embodiment of the present invention comprises the mounting structure and the base, being structured from a material having sufficient flexibility to be disposed in overlying, at least partially covering relation to the shoulder area of the individual wearing the garment. It is to be further noted that the base, whether it is used in combination with the mounting structure or not, may be connected to a garment at various locations other than being draped in overlying relation to the shoulder area of the garment and/or individual wearing the garment.

At least partially dependent of the application where the illumination assembly is used, it may be structured to include the base preferably having a substantially elongated configuration. Also, at least one embodiment of the base comprises preferably at least two base segments extending longitudinally along the length thereof in transversely spaced relation to one another. As such, the base segments may define the outer edges or peripheral portions of the base and extend along at least the majority and/or preferably the entirety of the length of the base.

Additional structural and operative features of the illumination assembly include an adjustment assembly comprising at least one adjustment member movably connected to the base and disposed in a transverse orientation relative to the length thereof. Further, an illumination source is movably connected to the one adjustment member and movable both along the length thereof, transversely to the length of the base, as well as along the length of the base with the one adjustment member. Accordingly the one adjustment member is movably connected to the base, such as by being movably attached at its opposite ends to the aforementioned base segments, and thereby is movable relative to the base along the length thereof. The illumination source, movably connected to the one adjustment member and supported thereon, is thereby movable along the length of the base with the one adjustment member.

Therefore, at least one preferred embodiment of the illumination assembly of the present invention comprises an enhanced adjustability of the illumination source on the base so as to accomplish a multi-directional movement and multi-positionable placement of the illumination source both longitudinally and transversely on the base. Due to the movable connection of the one adjustment member on the base and the cooperative, movable connection of the illumination source on the one adjustment member both the adjustment member and the illumination source may be movable with one another reciprocally along the length of the base. Concurrently or independently, the illumination source may be reciprocally movable along the length of the one adjustment member and as such will be reciprocally movably in a transverse direction relative to the base.

In order to further enhance the versatility, as well as the accurate and selective disposition of the illumination source at various locations on the base, at least one guide member may also be provided. When utilized, the one guide member is mounted on or connected to the base at a location preferably intermediate the longitudinal sides and extends along at least a majority of the base. Moreover, when the base incorporates the aforementioned two elongated base segments, the guide member may be preferably disposed there between, and extend along at least a majority of the length thereof. The provision of the one guide member serves to facilitate a stable and accurate disposition of the one adjustment member as it moves longitudinally along the base.

Therefore, the one adjustment member is movably connected to the base, such as by being movably connected to the two base segments at opposite ends of the adjustment member. Concurrently, the one adjustment member is movably connected to the one guide member at a location substantially intermediate the opposite ends of the one adjustment member. As a result, longitudinal movement of the one adjustment member along the length of the base comprises the opposite ends and the intermediate portion of the one adjustment member moving, possibly reciprocally, along the length of the two base segments and one guide member, concurrently. As also indicated herein, the illumination source is movably connected to the one adjustment member so as to move along the length thereof and is also movable with the one adjustment member as it moves along the length of the base. Therefore, the illumination source is concurrently movable along the length of and relative to the aforementioned base segments and one guide member, with the one adjustment member so as to accomplish the multi-positionable placement and multi-directional movement thereof relative to the base.

In one or more preferred embodiments, the one adjustment member may be formed, at least in part, from an elastic material to further facilitate the selective positioning and movement of the illumination source along the length of the one adjustment member. Similarly, the one guide member may also be at least partially formed of an elastic material, wherein the "stretchable" nature thereof also enhances the intended, selective positioning of the one adjustment member, with the illumination source attached thereto. As such, the illumination source can move along the length of the base, as the one adjustment member moves reciprocally and concurrently along the length of the two base segments and the one guide member.

In use a single illumination assembly may be mounted on the garment in removable connection to the aforementioned mounting assembly or independently thereof. As also indicated a preferred location of the illumination assembly and/or more specifically the base would be in an overlying, somewhat draped relation to the shoulder area to the individual and the garment when worn by the individual. However, depending upon the specific use, environment and/or application, a plurality of at least two illumination assemblies may be supported on the individual preferably in removable connection to corresponding mounting structures, wherein each of the at least two illumination assemblies are disposed in overlying somewhat draped relation to different shoulders of the garment and the individual wearing the garment. As also set forth above, different locations of each of the one or more illumination assemblies may be determined so as to accommodate needs and desires of the individual. Also the size, type and configuration of the garment on which the illumination assemblies are used may also be partially determinative of the location of the one or more illumination assemblies.

The illumination source associated with the one or more illumination assemblies may comprise a commercially available source of illumination, such as incandescent lamp, LED, etc. Also, the illumination source may be movably connected to a platform, wherein the platform is movably connected to the one adjustment member in the manner described above. As such, the illumination source may be pivotally, hingedly, or otherwise adjustably connected to the platform so as to allow the individual to more precisely direct or "aim" the field of illumination issuing from the illumination source. In other preferred embodiments the illumination source may be used with or without the aforementioned supporting platform and may be otherwise structured in a customized manner so as to further meet the needs and desires of the individual.

It is of further note that the one or more preferred embodiments of the illumination assembly as described above is accomplished with an indication that the base, one adjustment member, guide member, illumination source, are all part of a single unit which in turn may be removably connected to the garment in the manner indicated. However, it is within the spirit and scope of the present invention to fixedly attach the base whether used in combination with or independently of a mounting structure and further wherein one or more of the illumination assemblies may be so fixedly mounted. The fixed or removable connection of the one or more illumination assemblies is dependent, at least in part, on the use, application, environment, etc. in which the various embodiments of illumination are applied.

These and other objects, features and advantages of the present invention will become clearer when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which:

FIG. 3 is a rear view in partial cutaway of an illumination source and support platform associated therewith.

FIG. 4 is a front view in partial cutaway of the embodiment of FIG. 3.

Like reference numerals refer to like parts throughout the several views of the drawings.

DETAILED DESCRIPTION OF THE PREFERRED EMBODIMENT

Figure 6:
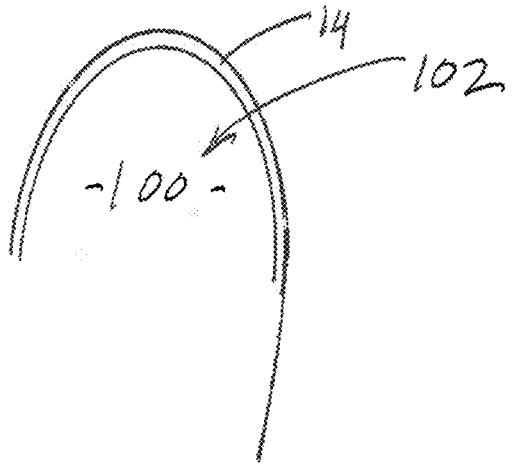
FIG. 6 is a schematic representation of the mounting assembly of the embodiment of FIG. 2 and its connection to a garment for interconnecting the illumination assembly to the garment.

As represented in the accompanying Figures, the present invention is directed to an illumination assembly, generally indicated as 10, including a base generally indicated as 12. The illumination assembly 10 and more specifically the base 12 is intended to be supported on an individual, such as by being fixedly or removably connected to a garment 100 worn by the individual, as schematically represented in FIG. 6, and explained in greater detail hereinafter.

Figure 2:
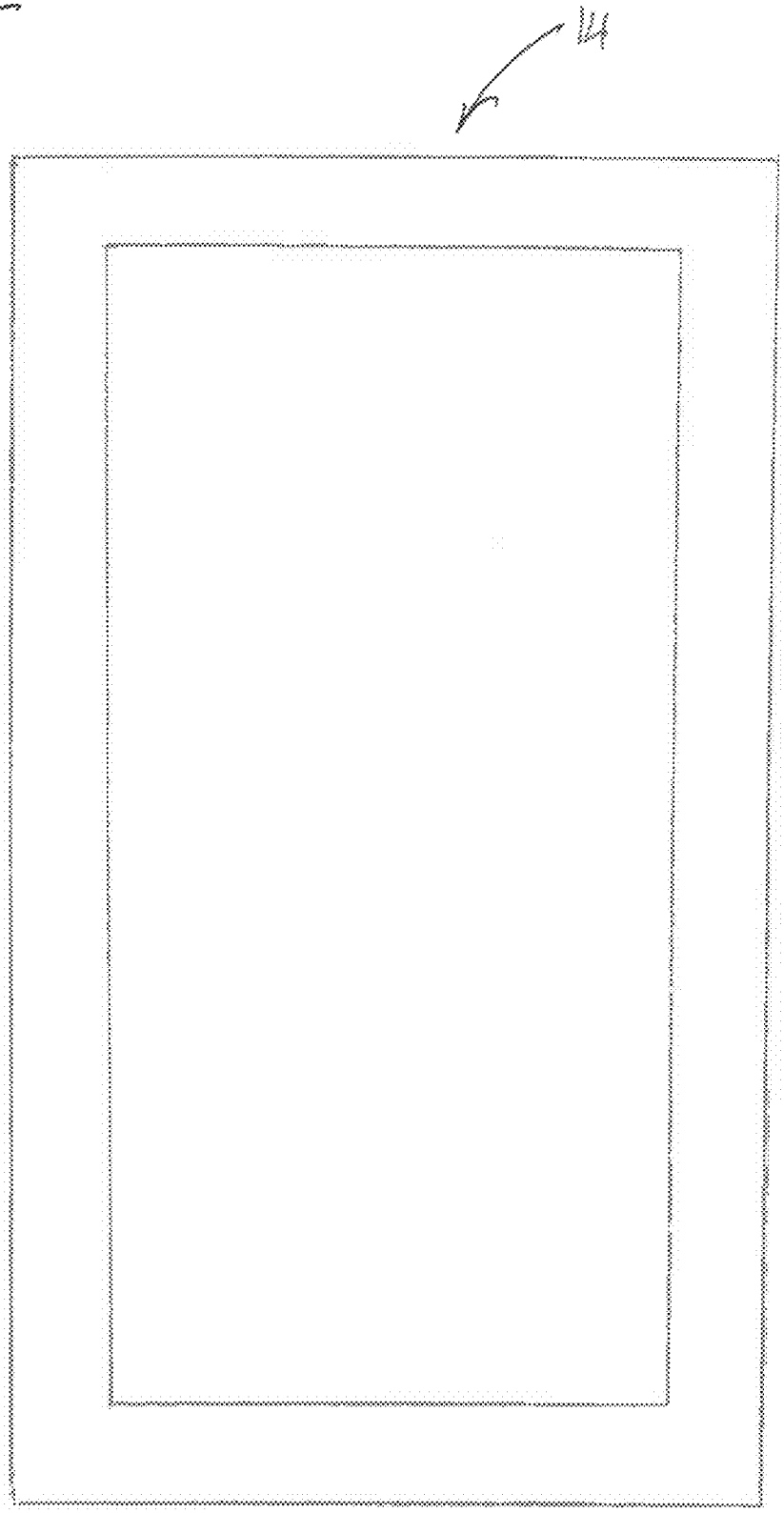
FIG. 2 is a front plan view of a mounting structure on which a base portion of the illumination assembly of the embodiment of FIG. 1 may be mounted to facilitate connection to a garment worn by the individual.

Moreover, in at least one preferred embodiment, the base 12 is removably connected to the garment 100 by the inclusion of a mounting structure generally indicated as 14, represented in FIG. 2. The mounting structure may be fixedly or removably connected to the garment 100. Further, the exterior surface or like portion of the mounting structure 14 may be cooperatively structured with the undersurface of the base 12 to facilitate a mounting or connection of the base 12 to the mounting structure 14 and on the garment 100. The preferred removable connection may be in the form of a hook and loop type connector, but other type connector such as, but not limited to, snaps, buttons, zippers, etc. may be used to accomplish the removable or fixed connection, as set forth above.

Figure 1:
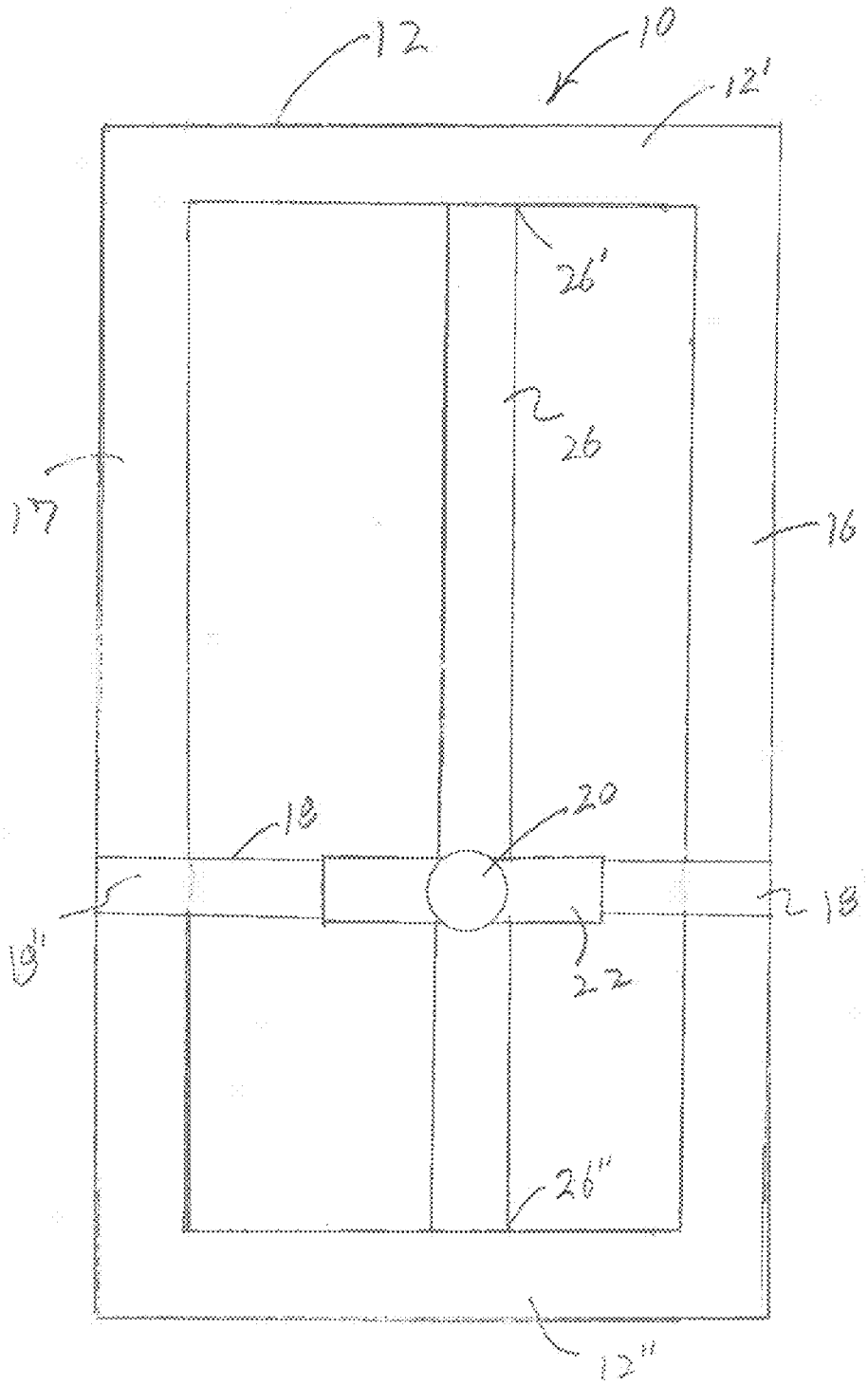
FIG. 1 is a front plan view of one preferred embodiment of the illumination assembly of the present invention.

Again with primary reference to FIG. 1, the base 12 preferably includes an elongated configuration and be formed of a sufficiently flexible material to at least partially conform to a corresponding portion of the body of the wearer and the garment 100. In addition, the base 12 may include two base segments 16 and 17 disposed in spaced relation to one another and extending at least along a majority, but preferably, the entirety of the length of the base 12. As such, the disposition of the base segments 16 and 17 may substantially correspond to the longitudinally peripheral edges or sides of the base 12. When the elongated spaced apart base segments 16 and 17 are utilized, interconnecting portions as at 12' and 12" may serve to interconnect and thereby facilitate the relative position of the base segments 16 and 17. Moreover, the base segments 16 and 17 and the connecting portions 12' and 12" may define an integral formation or may be connected at their junctions or intersecting portions.

The illumination assembly 10 also includes an adjustment assembly comprising a plurality of adjustment members 18. As represented in FIG. 1, at least one adjustment member 18 is utilized and has an elongated configuration. While a single adjustment member 18 is represented in the accompanying Figures, each of a plurality of adjustment members may include a substantially equivalent structure. The one adjustment member 18 is movably connected to the base 12 in a substantially transverse orientation to the length thereof as represented in both FIG. 1. In addition, at least one illumination source generally indicated as 20 is connected to the one adjustment member 18 so as to move with the adjustment member 18 reciprocally along the length of the base 12. The at least one illumination source 20 is mounted on and supported by a platform 22, which itself is movably connected to the one adjustment member 18 so as to move reciprocally along the length of the adjustment member 18.

Accordingly, the interconnection and cooperative structuring of each of the one or more adjustment members 18, at least one illumination source 20 and support platform 22 is such as to facilitate movement of the light source 20 along the length of the one adjustment member 18 along with the platform 22. Concurrently or independently, the one adjustment member 18 and the illumination source 20 attached thereto may move reciprocally along the length of the base 12. As a result, the cooperative structuring of the various components of the illumination assembly 10 including the base 12, adjustment member 18, illumination source 20 and support platform 22 provides a multi-positional placement and multi-directional and/or reciprocal movement of the illumination source 20 relative to the base 12.

Additional structural features facilitating the multi-positional placement and multi-directional movement as described above includes opposite ends of the one adjustment member 18 being transversely disposed between and movably connected to the base segments 16 and 17. More specifically the opposite ends as at 18' and 18" may be cooperatively structured so as to "slide" along the length of correspondingly disposed base segments 16 and 17 in a reciprocal direction. Therefore, in at least one embodiment both the opposite ends 18' and 18" may be structured in the form of a loop or other configuration disposed in at least partially surrounding relation to the corresponding base segments 16 and 17. As such the loops ends 18' and 18" may move telescopically in opposite, reciprocal directions along the corresponding base segments 16 and 17.

In order to further facilitate the stability of the illumination source 20 on the one adjustment member 18, as well as the overall stability and accurate placement of the one adjustment member 18 relative to the base 12, at least one preferred embodiment of the present invention includes at least one guide member 26. The guide member 26 is connected to the base and extends along at least a majority, but preferably the entirety of the length thereof. Further, the adjustment member 26 has its opposite ends 26' and 26" connected to or integrally formed as part of the interconnecting portions 12' and 12". As also represented, the one guide member 26 is disposed intermediately between the spaced part base segments 16 and 17. Such a location of the one guide member 26 also facilitates its movable connection to the adjustment member 18 at a location intermediate the opposite ends 18' and 18" as also represented in FIG. 1.

The movable connection of the one adjustment member 18 to the guide member 26, concurrently to the opposite ends 18' and 18" being movably connected to the base segments 16 and 17, will facilitate the concurrent movement of the adjustment member 18 along the length of the base 12 relative to the base segments 16 and 17 as well as the guide member 26. As a result, the illumination source 20 can move transversely to the length of the base 12, as it moves along the length of the one adjustment member 18. Concurrently or independently, the one adjustment member 18 and the illumination source 20 may move together along the length of the base 12, due to the fact that the one adjustment member 18 is concurrently and movably connected to the base segments 16 and 17 and the guide member 26.

Figure 5:
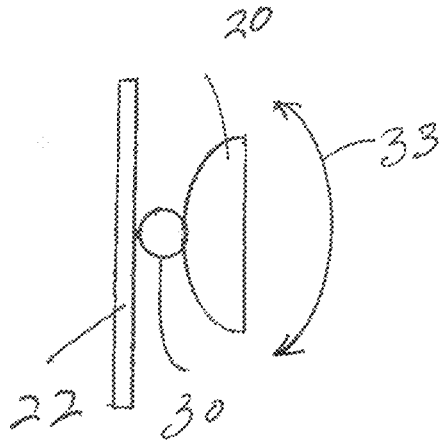
FIG. 5 is an end view of an illumination source and associated support platform of the embodiment of FIGS. 3 and 4.

With primary reference to FIGS. 4 through 6, additional structural features which enable the aforementioned multi-positional placement and multi-directional movement of the illumination source 20 relative to the base 12 include the cooperative structuring of the support platform 22 as well as the cooperative disposition of the one adjustment member 18 and the guide member 26. More specifically, the support platform 22 may include oppositely disposed openings or apertures 23 formed in spaced relation to one another substantially adjacent opposite ends of the platform 22. The openings or apertures 23 are adequately dimensioned to allow the passage or "threading" of the one adjustment member 18 therethrough in the manner indicated in FIGS. 5 and 6. Moreover, and with primary reference to FIG. 5 movable interaction and/or connection of the one adjustment member 18, platform 22 and guide member 26 includes the guide member 26 passing through additional openings 25 and beneath the adjustment member 18. As such, the adjustment member 26 may be disposed over the rear surface 27 of the platform 22 so as to be disposed between the rear surface 27 and the under, non-exposed surface of the one adjustment member 18.

This type of interaction facilitates reciprocal movement of the platform 22, with the illumination source 20 mounted thereon, along the length of the one adjustment member 18 as indicated by directional arrow 29. Concurrently, the support platform 22, with the illumination source 20 thereon may move, along with the one adjustment member 18 along the length of the two base segments 16 and 17, as described above and also reciprocally along the guide member 26 in accordance with directional arrow 31. The aforementioned multi-positional placement and multi-directional movement of the illumination source 20 is thereby readily accomplished.

With primary reference to FIGS. 4 and 5, the illumination source 20 may comprise any type of appropriate source of illumination such as an incandescent light bulb, LED, etc. At least one preferred embodiment of the illumination source 20 is pivotally or otherwise hingedly connected to the platform 22 so as to be selectively adjustable relative thereto in a somewhat pivotal and/or reciprocal manner, as schematically indicated by directional arrow 33. Such a pivotal or like connection 30 may take a variety of forms and serve to mount the illumination source 20 to the platform 22 so as to move therewith relative to the base 12, while concurrently allowing the pivotal movement 33 of the illumination source 20 relative to the platform 22 and accordingly relative to the base 12.

FIG. 6 is a schematic representation of yet another embodiment of the present invention, wherein the mounting assembly 14 is fixedly or removably to the garment 100 and has sufficient flexibility to be at least partially disposed an overlying at least somewhat "draped" relation to the shoulder area, generally indicated as 102 of the garment 100 and the individual wearing the garment. Similarly, the base 12 also has sufficient flexibility to conform to the disposition of the mounting structure 14 and be fixedly but preferably removably attached thereto by an appropriate hook and loop type fastener, button fastener, zipper, snap, etc. When connected to the mounting structure 14 the base 12 will also form the substantially overlying, draped orientation, wherein the illumination source 20 will preferably be disposed on the frontal portion of the garment and the wearer and be selectively and pivotally adjustable as at 33 to direct the generated field of light to a location preferred by the wearer of the garment 100.

Figure 9:
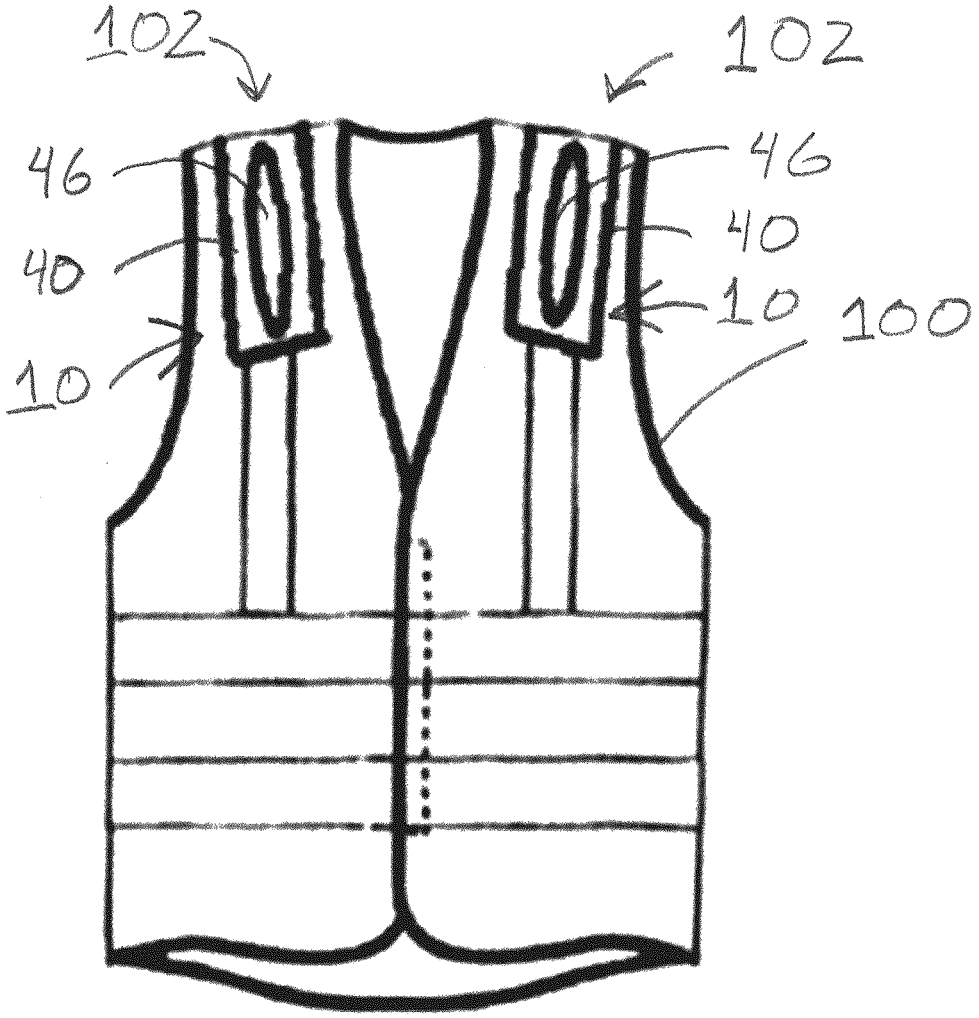
FIG. 9 is a front plan view of one embodiment of the illumination assembly of the present invention disposed upon a garment in connection with the present invention.
Figure 10:
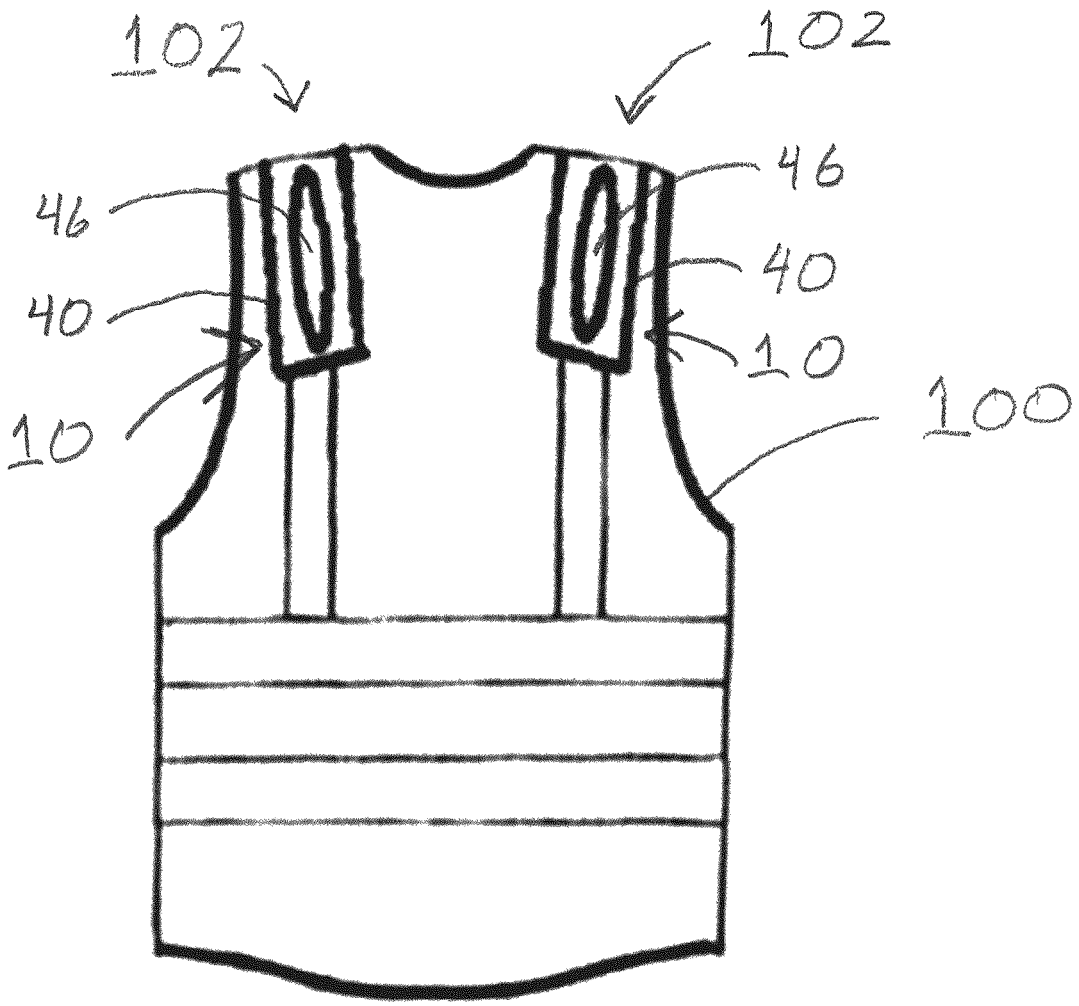
FIG. 10 is a rear plan view of the embodiment depicted in FIG. 9.

Further reference may be had to FIGS. 9 and 10 for a depiction of the illumination assembly 10 of the present embodiment mounted to a garment 100 and including sufficient flexibility to be at least partially disposed in overlying relation to the shoulder area 102. More specifically, the garment 100, as depicted in the embodiment of FIGS. 9 and 10, comprises a vest such as a high-visibility safety vest. Additionally, the embodiment of the illumination assembly 10 includes a cover 40 with one aperture 46 on the front of the garment 100 and one aperture 46 on the rear of the garment 46. It should be appreciated that virtually any number and configuration of apertures 46 may be provided in addition to the embodiment depicted in FIGS. 9 and 10.

In order to enhance the versatility of the illumination assembly 10 and its use, the mounting structure may be structured to have a sufficiently reduced thickness to substantially conform to the garment in a manner as to not excessively protrude outwardly from the outer surface of the garment. Therefore, when the base 12 and illumination source 20 is removed from the mounting structure 14, the garment 100 with the mounting structure remaining thereon can be used in the conventional manner. By way of example, an over garment, such as a jacket, sweater, etc. can be worn over the original garment 100, in overlying relation to the mounting structure 14. Due to the preferred thinness, such as in the range of ¼ inch to ½ inch thickness, the mounting structure 14 will not excessively protrude outwardly form the outer surface of the garment 100 and therefore be substantially unobtrusive when an over garment is worn over the original garment 100 to which the mounting structure 14 is attached.

Figure 7:
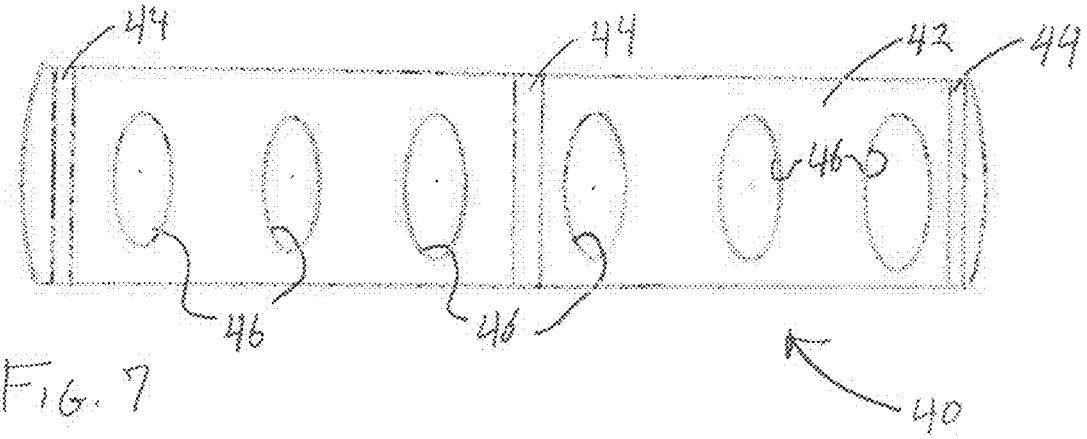
FIG. 7 is a front plan view of another preferred embodiment of the present invention directed to a safety cover.
Figure 8:
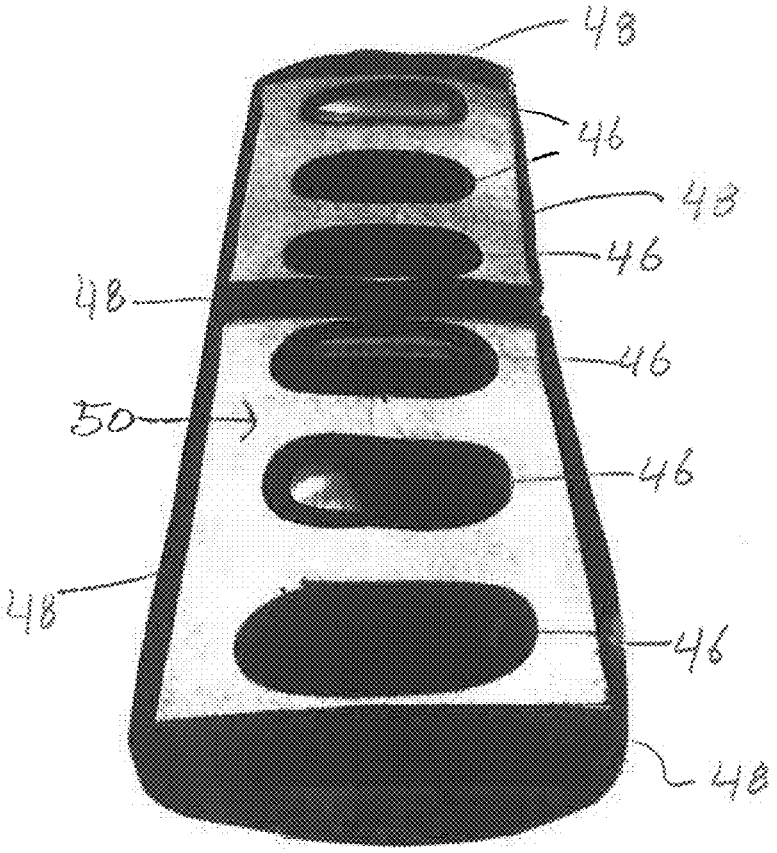
FIG. 8 is a rear perspective view of the embodiment of FIG. 7.

In order to enhance visibility and therefore the safety of an individual using the illumination assembly 10, yet another embodiment of the present invention includes the provision of a cover 40, as represented in FIGS. 7 and 8. The cover 40 is cooperatively structured with the illumination assembly 10, to the extent of being correspondingly dimensioned and configured to at least a portion of the base 12. As such, the cover 40 may be substantially elongated and operatively disposed in overlying, at least partially covering relation to a portion of the base 12 or substantially the entire length of the base 12. Further, when operatively disposed on the base 12 the outer surface 42 of the cover 40 is exposed and clearly viewable.

Accordingly, in order to enhance the visibility and safety of the individual, as set forth above, at least a portion of the outer surface 42 includes and/or is formed from a light reflective material.

Such light reflective material may include, but is not limited to, a luminescent material. Moreover, as represented in FIG. 7, the reflective material may comprise one or more light reflective segments 44 disposed in spaced and/or other prearranged relation to one another on the outer surface 42. Therefore, the reflective segments 44 may include a plurality of elongated strips transversely disposed in spaced relation to one another along the length of the cover 40. Further by way of example, the light reflective material may assume a single reflective segment extending over a sufficiently sized portion or area of the outer surface 42 to enhance the visibility and safety characteristics of the cover 40, as indicated herein. As yet another alternative, a plurality of differently configured reflective segments may disposed on the outer surface 42 in a predetermined array or pattern which facilitates the visibility of the cover 40, as well as the illumination source 20 and garment 100 worn by the individual.

The structural versatility of the cover 40 is such as to allow it to be operatively connected in overlying relation to the base 12 with the illumination source 20 in place. As set forth above, the illumination source is attached to the platform 22 and movable therewith relative to the adjustment member 18. Therefore, the cover 40 includes at least one aperture 46, extending through the cover 40, and dimensioned and configured to receive the illumination source 20 therein and allow it to extend through the cover 40. As a result, when the cover 40 is operatively disposed in at least partially covering relation to the base 12, it may also overlie the illumination source 20. However, due to the provision of the at least one aperture 46, the illumination source 20 can pass through the cover 40 and still be activated to illuminate the area surrounding the individual.

As explained above, the illumination source 20 is variably and selectively positioned along the length of the adjustment member 18 and also along the length of the base 12. Accordingly, the cover 40 preferably includes a plurality of the apertures 46 disposed in spaced relation to one another. Each of the apertures 46 is dimensioned and configured to receive the illumination source 20 therein and allow it to extend through the cover 40. As a result, the cover 40 may operatively cover at least a portion of the base 12 when the illumination source 20 is disposed in any one of a plurality of different locations on the base 12.

As clearly represented in FIG. 8, one method of removably securing the cover 40 in the operative overlying relation to the base 12 may include the provision of an appropriate connecting structure, generally represented as 48. In at least one embodiment, the connecting structure 48 is preferably mounted on or attached to the under surface 50 of the cover 40. Such a connecting structure 48 may include, but not be limited to, a hook and loop type connector extending about the outer periphery and/or at least partially across the width of the outer surface 48, as represented. It is emphasized the connecting structure 48 may include other type connectors disposed in other locations than that represented in FIG. 8, which are appropriate to removably connect the cover 40 to the base 12.

Also, the cover 40 is preferably made of a lightweight, durable and flexible material. The flexibility of the cover 40 should be sufficient to facilitate its conformance to the base 12 such as, but not limited to, when mounted on a garment 100 as represented in FIG. 6. The cover 40 may also have a preferred thinness, such as in the range of ¼ inch to ½ inch thickness, similar to the mounting structure 14, so as to be substantially unobtrusive when connected to the base 12 and disposed beneath an over garment.

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An illumination assembly structured to be supported on an individual, said illumination assembly comprising:

a base structured to be connected to an individual's garment, an adjustment assembly movably connected to said base, an illumination source connected to said adjustment assembly and movable along a length thereof relative to said base, said adjustment assembly and said base cooperatively structured to facilitate a selective, multi-positional placement of said illumination source on said base, and said base comprising two base segments each extending along longitudinal portions of said base in spaced relation to one another, said adjustment assembly including at least one adjustment member movably connected to each of said base segments in transverse relation to a length of said base and selectively positionable along a length of said base, and said base further comprising an elongated guide member extending along a length of said base intermediate said two base segments, said one adjustment member movably connected to said guide member and movable, with said illumination source, relative to said guide member along the length of said base.

2. An illumination assembly as recited in claim 1 wherein said adjustment assembly is disposed in movably interconnecting relation between said illumination source and said base; said illumination source and said adjustment assembly being concurrently movable along a length of said base and cooperatively structured therewith to facilitate adjustable, multi-directional movement of said illumination source on said base.

3. An illumination assembly as recited in claim 1 further comprising a mounting structure connected to the garment, said base removably connected to said mounting structure and correspondingly positioned therewith on the garment.

4. An illumination assembly as recited in claim 3 wherein said mounting structure is dimensioned and configured to substantially conform to the garment and assume an underlying, unobtrusive relation to an over garment.

5. An illumination assembly as recited in claim 3 said mounting structure is dimensioned and structured to assume an overlying disposition over the shoulder area of the garment and the individual.

6. An illumination assembly as recited in claim 5 wherein said base is dimensioned and configured to substantially conform to said overlying disposition of said mounting structure when removably connected thereto.

7. An illumination assembly as recited in claim 1 wherein said adjustment assembly comprises at least one adjustment member extending substantially transversely to a length of said base, said one adjustment member movable along the length of said base.

8. An illumination assembly as recited in claim 7 wherein in said one adjustment member comprises an elongated configuration, said illumination source movably connected to said adjustment member and reciprocally moveable along the length thereof, transversely to the length of said base.

9. An illumination assembly as recited in claim 8 wherein said one adjustment member and said base are cooperatively structured to facilitate selective, multi-directional movement and multi-positional placement of said illumination source both longitudinally and transversely along said base.

10. An illumination assembly as recited in claim 7 wherein said illumination source is movable transversely to a length of said base along a length of said one adjustment member and longitudinally along said base with said one adjustment member.

11. An illumination assembly as recited in claim 1 wherein said illumination source is movably connected to said one adjustment member and selectively positionable along a length thereof relative to said two base segments and along the length of said base segments with said adjustment member, relative to said base.

12. An illumination assembly as recited in claim 1 wherein said one guide member and said one adjustment member are at least partially formed of an elastic material.

13. An illumination assembly as recited in claim 1 further comprising a mounting structured connected to the garment, said base removably connected to said mounting structure in correspondingly positioned therewith on the garment.

14. An illumination assembly as recited in claim 13 wherein said mounting structure is dimensioned and configured to substantially conform to the garment and assume a substantially unobservable relation to an overlying garment.

15. An illumination assembly as recited in claim 13 wherein said mounting structure is dimensioned and structured to assume an overlying disposition on the shoulder area of a the garment and the individual.

16. An illumination assembly as recited in claim 15 wherein said base is dimensioned and configured to substantially conform to said overlying disposition of said mounting structure when connected thereto.

17. An illumination assembly structured to be supported on an individual, said illumination assembly comprising:

a base structured to be supported on an individual, an adjustment assembly including at least one adjustment member movably connected to said base, said movable connection including a slidable relation between at least a portion of said adjustment assembly and said base;

an illumination source connected to said one adjustment member and moveable relative thereto along a length thereof and therewith relative to a length of said base, said one adjustment member, said base and said illumination source cooperatively structured to facilitate selective, multi-directional movement and multi-positional placement of said illumination source relative to said base, said base comprising two elongated base segments each extending along longitudinal portions of said base in spaced relation to one another, said one adjustment member movably connected to each of said two base segments in transverse relation to the length of said base, said one adjustment member and said illumination source moveable with one another relative to said two base segments, along a length of said base, and said base further comprising at least one elongated guide member extending along the length of said base, said one adjustment member movably connected to said guide member and movable, with said illumination source, relative to said guide member along the length of said base.

18. An illumination assembly as recited in claim 17 wherein said illumination source is movably connected to said one adjustment member and reciprocally positionable along a length thereof relative to said base segments and reciprocally positional along the length of said base segments with said adjustment member.

19. An illumination assembly as recited in claim 17 wherein said one guide member and said one adjustment member are at least partially formed from an elastic material.

20. An illumination assembly as recited in claim 17 further comprising a mounting structure connected to a garment of the individual, said base removably connected to said mounting structure and correspondingly positioned therewith on the garment, said mounting structure dimensioned and structured to assume an overlying, at least partially curved configuration along the length thereof, over the shoulder area of the garment and the individual.

21. An illumination assembly structured to be supported on an individual, said illumination assembly comprising:

a base structured to be supported on an individual, an adjustment assembly including at least one adjustment member movably connected to said base, said movable connection including a slidable relation between at least a portion of said adjustment assembly and said base;

an illumination source connected to said one adjustment member and moveable relative thereto along a length thereof and therewith relative to a length of said base, said one adjustment member, said base and said illumination source cooperatively structured to facilitate selective, multi-directional movement and multi-positional placement of said illumination source relative to said base, and a cover removably disposable in overlying relation to at least a portion of said base, said cover dimensioned and configured to substantially correspond to a configuration of at least a portion of said base and including at least one opening, said one opening dimensioned to facilitate passage of said illumination source therein and through said cover.

22. An illumination assembly as recited in claim 21 wherein said cover further comprises a plurality of apertures extending there through and collectively disposed along a length of said base in spaced relation to one another, each of said apertures disposed and dimensioned to facilitate passage of said illumination source therein and through said cover.

23. An illumination assembly as recited in claim 21 wherein said cover further comprises a reflective material disposed on a visually observable location on an outer surface of said cover.

24. An illumination assembly as recited in claim 23 wherein said reflective material is at least partially luminescent.

* * * * *